US005562203A

United States Patent [19]

Mochizuki

[11] Patent Number: 5,562,203

[45] Date of Patent: Oct. 8, 1996

[54] KEYSWITCH

[75] Inventor: Isao Mochizuki, Gifu-ken, Japan

[73] Assignee: Brother Kogyo Kabushiki Kaisha, Nagoya, Japan

[21] Appl. No.: 526,100

[22] Filed: Sep. 11, 1995

[30] Foreign Application Priority Data

Oct. 20, 1994 [JP] Japan ..... 6-255622

[51] Int. Cl.[6] ..... H01H 13/70

[52] U.S. Cl. ..... 200/345; 200/517; 200/341

[58] Field of Search ..... 200/341, 344, 200/345, 512, 515, 517, 5 A, 520

[56] References Cited

U.S. PATENT DOCUMENTS 3,909,564 9/1975 Scheingold et al. ..... 200/517
4,314,113 2/1982 Nelson ..... 200/345
4,492,838 1/1985 Fukukura ..... 200/517
4,560,845 12/1985 Takamura et al. .
4,580,022 4/1986 Oelsch et al. .
4,952,762 8/1990 Koyanagi ..... 200/517
5,256,843 10/1993 Chiba et al. ..... 200/517
5,280,147 1/1994 Mochizuki et al. .

*Primary Examiner*—David J. Walczak
*Attorney, Agent, or Firm*—Oliff & Berridge

[57] ABSTRACT

A keyswitch for a keyboard used with a computer or similar device that has a keytop linked to the base board. A printed circuit board having a contact switch associated with each keytop is associated with the base board. Linking each keytop with the base board is a scissors type guide. A pair of resilient springs are attached to the guide. One of the springs is in continual contact with the base board and: the other spring contacts the contact switch only after the keytop has been depressed a fixed distance thereby closing the contact switch.

24 Claims, 7 Drawing Sheets

KEYSWITCH

BACKGROUND OF THE INVENTION

1. Field of the Invention

The invention relates to a keyswitch suitable for use on a keyboard which comprises the data-entry equipment of a word processor, personal computer or the like.

2. Description of Related Art

A known keyswitch for use on such a keyboard is disclosed in U.S. Pat. Nos. 4,580,022 and 4,560,845. These keyswitches are provided with a rubber spring, which is attached to the bottom of the keytop facing downward, and a stem that is inserted into a key holder part built into the holder element for guiding and supporting up and down movement. The key switches also include, on the lower portion of the stem, a contact point with a bottom face. Also, switching components, such as a membrane switch constituting an electrical contact with the flexible sheet, are also attached to the bottom edge of the rubber spring.

In addition, in the keyswitch described in U.S. Pat. No. 4,580,022, it was suggested that between the bottom face of the keytop and the holder element a link element be installed that has the shape of an X when viewed from the side, so that when one edge of the keys, such as space bars, on which the flat area is large compared with the contact component, is pushed down, the keytop will move up and down evenly and in parallel, with no inclination. The link element links both central portions in free movement.

In keeping with the recent reductions in the thickness of keyboards, a large keystroke is demanded in order to secure a reliable keystroke as well as to facilitate keyboard operation, in spite of the flattening of the keyboard.

However, in the existing keyswitches, keytop vertical movement is guided for the sliding contact of the keyholder component and the downwardly protruding stem is attached to the bottom of the keytop. Because of this, the vertical dimension of the guiding, sliding movement of the stem within the holder component must be reduced when trying to reduce keyboard thickness. In doing so, the problem arises that when the key is pressed down, a misalignment may occur between the stem and the holder. As a result, the key does not operate smoothly and easily. If the sliding contact guiding dimensions are increased to prevent this, then the problem arises of the keystroke being too short. Thus, it is very difficult to simultaneously solve the two mutually contradictory problems of obtaining a large keystroke and reducing keyboard thickness.

In order to solve the above problems, the applicant has proposed a keyswitch, described below, in U.S. Pat. No. 5,280,147. As shown in FIG. 5, the keytop 100 vertical movement guidance method comprises a first link 101 and a second link 102 arranged, in profile, like an X, or scissor like, with both links linked to move freely at the intersection component 103. In addition, one of the free ends 106,107 and 108,109 of the second link 102 and the first link 101, respectively, are fastened in horizontal, sliding contact with the bottom face of the keytop 100 and holder element 104, respectively. The other of the free ends 110,111 and 112,113 of second link 102 and first link 101, respectively, are rotatably fastened to the bottom face of keytop 100 and holder element 104, respectively. Also, beneath the center of the intersection component 103 is a cap-form rubber spring 105 having a resilient shape-changing capability. When the top 100 is depressed, the guiding means intersection component 103 causes the rubber spring 105 to undergo resilient shape-changes and the switching component associated therewith performs a switching operation.

However, with a keyswitch of such a design, the free end 112,113 of the first link 101 centers on the place on the holder element 104 that forms the rotational axis for the purpose of movement capability, and the intersection component 103 moves in an up and down motion. In addition, the rubber spring 105 shape is formed based on it being pressed down in a straight line by the intersection component 103. In other words, the upper face of the head of the cap shaped rubber spring is formed in a horizontal shape.

Thus, when the upper face of this type of rubber spring head portion is depressed in a downward slant direction by the intersection component 103, the degree of resilient shape change of the dome component (the dome component's seated position shape-change degree) of the rubber spring misaligns greatly relative to the near side and the far side of the rotation point of the first link 101 and problems arise in terms of the functioning of the depressed key, such as the switching operation relative to the switching component of the lower portion of the rubber spring.

Because inaccuracies arise in the position of the rubber spring which covers the switching component due to tight tolerances, there is the problem of imperfections in switching operation relative to the switching component of the lower portion of the rubber spring.

Also, there is the problem of the actual thickness of the rubber spring, which covers the switching component, becoming an obstacle to reducing the thickness of the keyboard.

SUMMARY OF THE INVENTION

The invention solves the above and other problems in the prior art. Its object is to provide a low-cost keyswitch that enables reliable key input as well as improving key input operation using a simple structure. It enlarges the keystroke while still allowing reduction in the size and thickness of the keyboard.

In order to accomplish the object, the keyswitch of the invention comprises a first link and a second link, arranged to intersect in an X-shape, or scissor shape, and includes a guiding element linking and fastening the bottom face of the keytop with the supporting base of its lower component which guides and supports the vertical movement of the keytop, a first spring element attached to at least one of the first link and the second link to raise the depressed keytop and a second spring element attached to at least one of the first link and the second link, to cause the switching component to switching contact when the keytop is depressed.

Also, it is preferable that the first spring element and second spring element be built into the first link.

Also, it is effective if the first spring element is in constant contact with the supporting base component, and if the second spring element only makes contact with the switching component and enacts switch movement when the keytop is depressed a fixed distance.

With the invention, endowed with such a structure, the guiding element is composed of the first link and the second link arranged to intersect in an X-shape, linking and fastening the keytop bottom face and the supporting base of its lower component for guiding and supporting vertical movement Of the keytop. In addition, the first spring is attached to at least one of the first link and the second link to raise the depressed keytop. Also, the second spring element is attached to at least one of the first link and the second link and causes the switching component to enact switch movement when the keytop is depressed. :

Also, when the first spring element and the second spring element are attached to the first link, it is possible to create a keyswitch with a simple structure.

Also, when the first spring element is in constant contact with the supporting base component, and when the second spring element makes contact with the switching component and enacts switch movement only when the keytop is depressed a fixed distance, the two spring elements can resist depression of the keytop after switching movement.

As is clear from the foregoing explanation, because the keyswitch of the invention combines in one the first and second spring elements and the first link, the benefits arise that the second spring elements position is securely fixed relative to the switching component of the printed board, and switching movement can be reliably accomplished. In addition, the depression load can be easily adjusted. Also, because rubber springs with a certain degree of thickness have been eliminated, the keyswitch can be made thinner, and the number of components is reduced making the assembly time shorter. The benefit, of great value to industry, is the ability to provide a lower cost keyswitch.

BRIEF DESCRIPTION OF THE DRAWINGS

A preferred embodiment of the invention is described in detail hereafter, with reference to the following figures wherein.

DETAILED DESCRIPTION OF PREFERRED EMBODIMENT

An embodiment realizing the invention will be described with reference to the drawings.

Figure 1A:
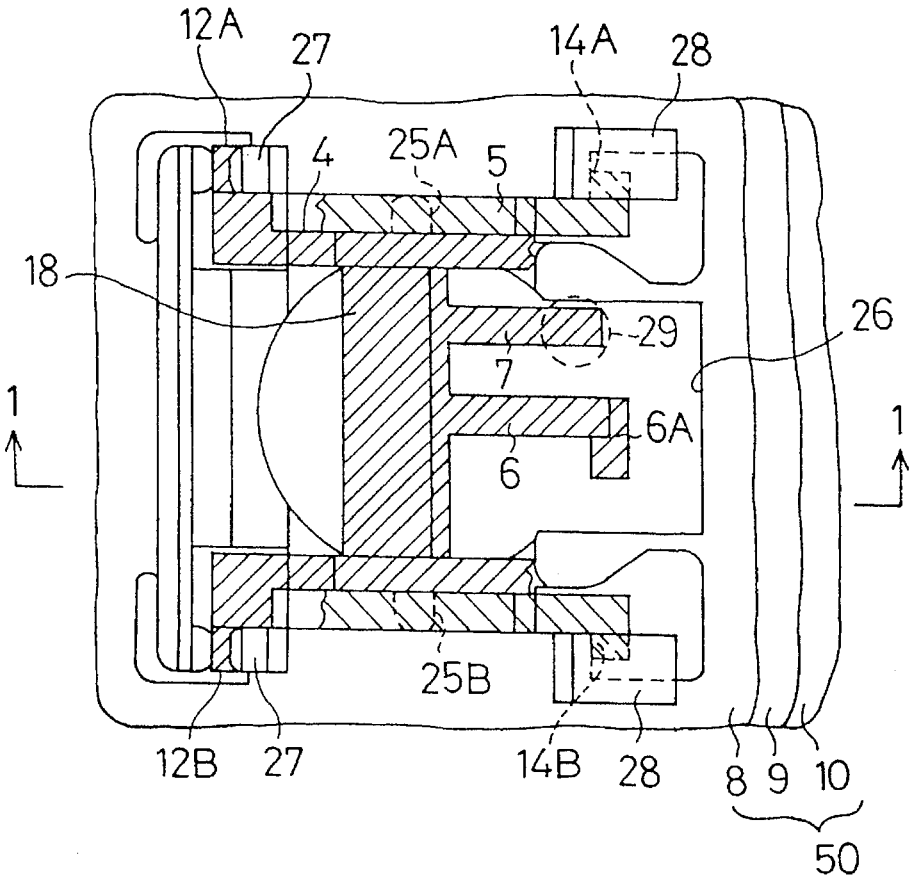
FIG. 1A is a top face view of the keyswitch embodiment of the invention wherein the keytop has been removed and components of the two links have been removed.
Figure 1B:
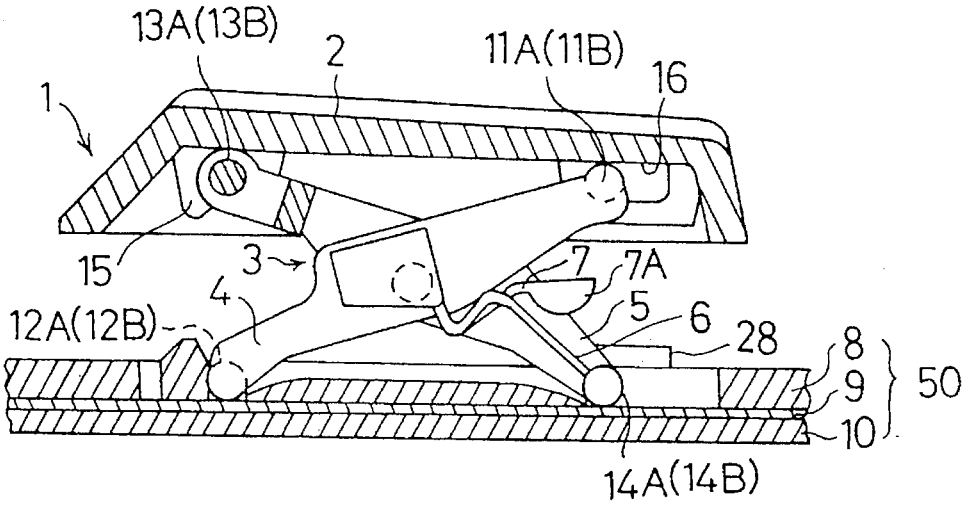
FIG. 1B is a side section view of the keyswitch along line 1—1 of FIG. 1A.
Figure 1C:
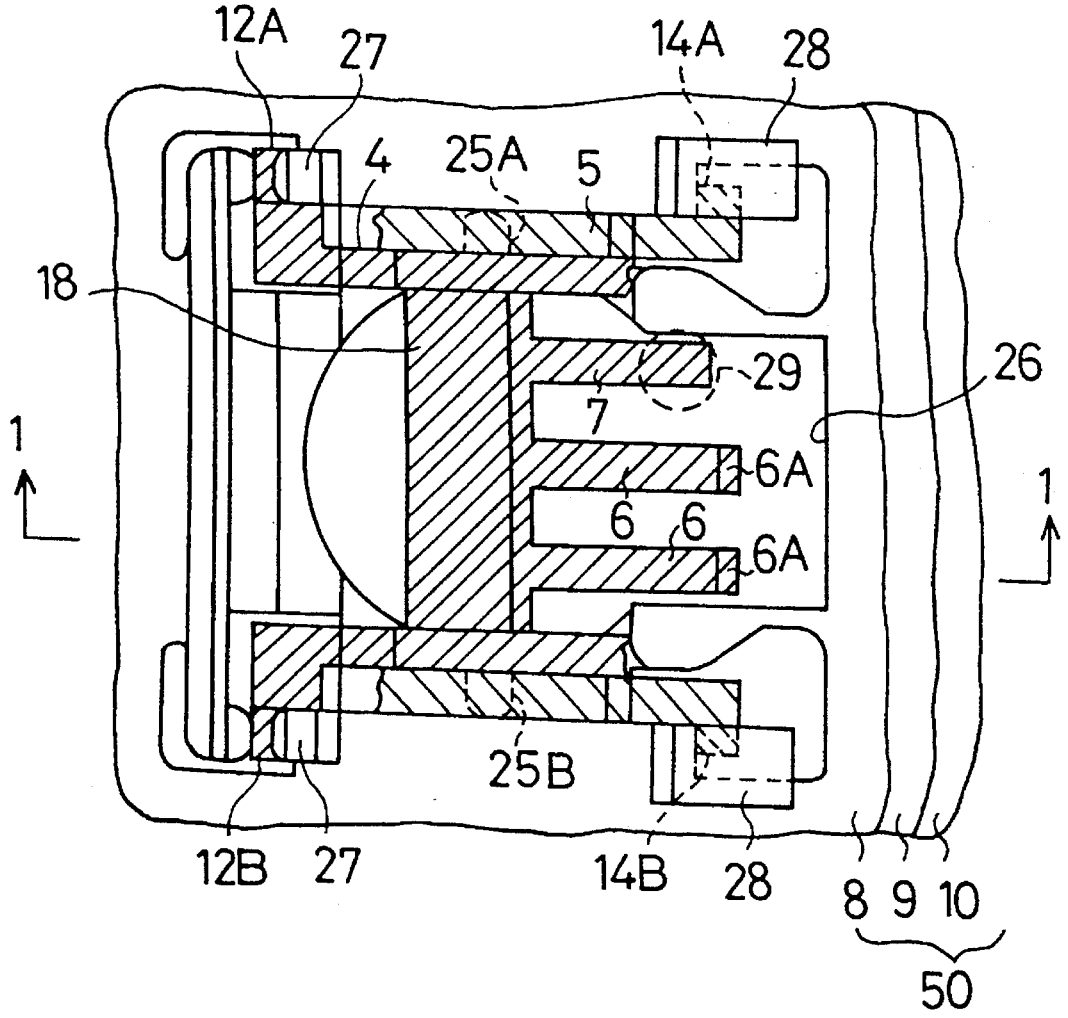
FIGS. 1C, 1D, and 1E are a top face view of the keyswitch of the invention wherein the keytop has been removed and various combinations of multiple springs are shown.
Figure 1D:
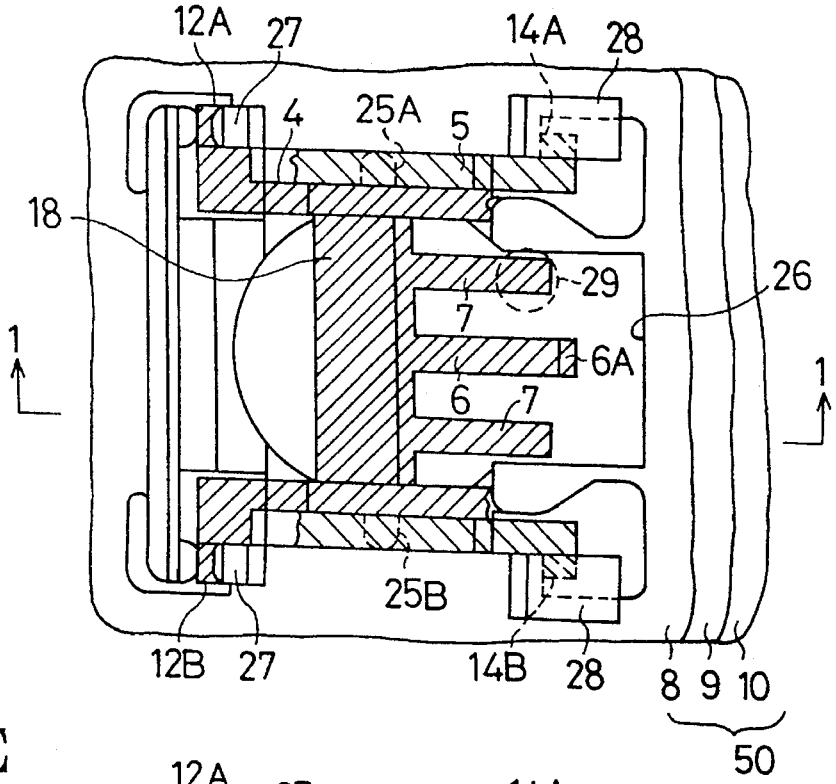
Figure 1E:
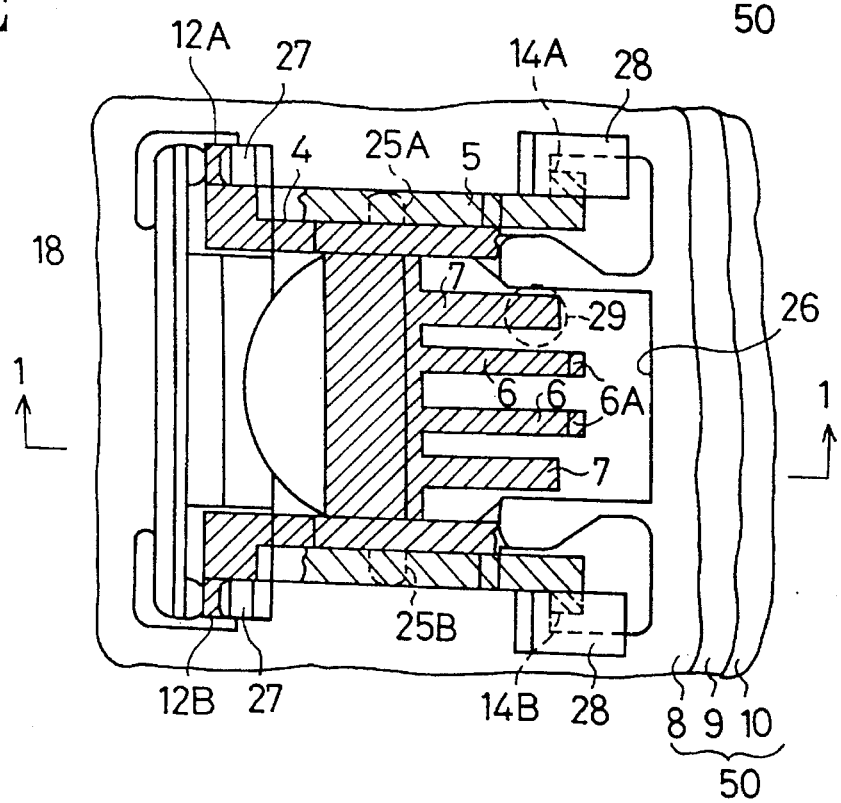

The structure of the keyswitch 1 will be described with reference to FIGS. 1A and 1B. FIG. 1A is a top face drawing in which the keytop 2 has been removed from the keyswitch. 1 and components of the two links have been removed. FIG. 1B is a side sectional drawing of the keyswitch 1.

The keyswitch 1 comprises a keytop 2, a guiding element 3 which can be attached to and detached from the keytop 2, and a supporting base component 50 that supports the guiding element 3. The keytop 2 is made of a synthetic resin, Such as ABS resin, and has a numeral, alphabetic character, or symbol placed on it through engraving or printing or the like. On the bottom face of the keytop 2 are built in circular-shaped pivot fastener components 15,15 to fasten and make possible only rotational movement of pivot axis components 13A,13B of a base component 22 (FIG. 3*c*) in a second link 5 (described below), and elongate groove shaped sliding fastener components 16,16 which receive pin components 11A,11B of the upper free ends of a first link 4 (described below) for brief horizontal sliding in front and back directions relative to the keytop 2.

Guiding element 3 is formed of the first link 4 and the second link 5 linked form an X when viewed from the side.

Figure 3A:
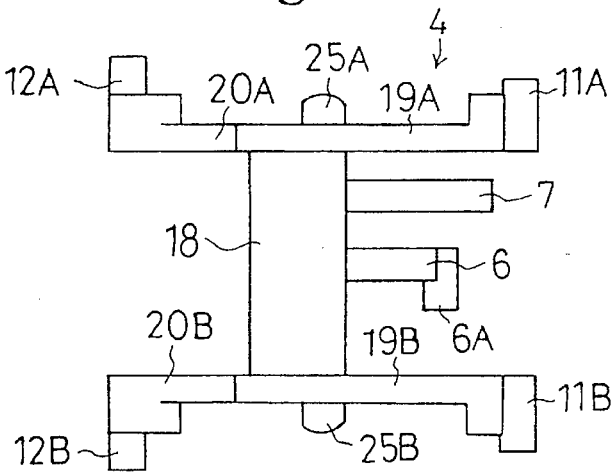
FIG. 3A is a top plan view of the first link.
Figure 3B:
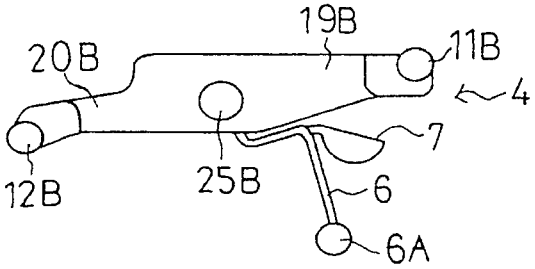
FIG. 3B is a side view of the first link.
Figure 3C:
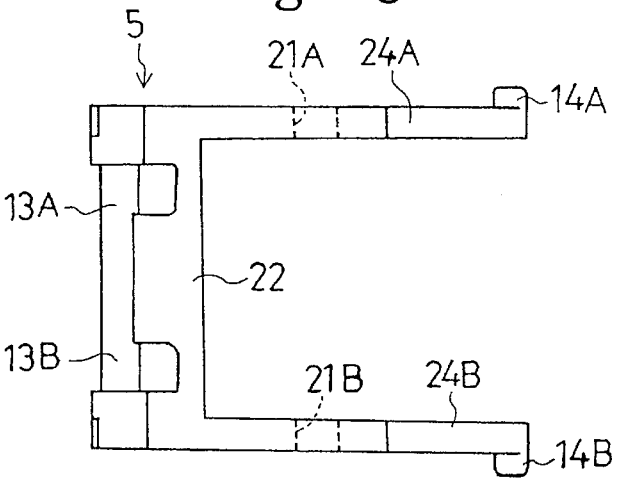
FIG. 3C is a top plan view of the second link.
Figure 3D:
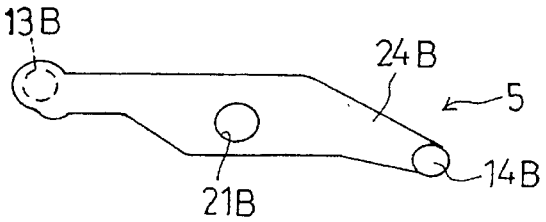
FIG. 3D is a side view of the second link.

The first link 4 and the second link 5 are made of a synthetic resin, such as glass fiber reinforced synthetic resin, and are described in detail hereafter with reference to FIGS. 3A–3D. FIG. 3A is a plan view of the first link 4, FIG. 3B is a side view of the first link 4, FIG. 3C is a plan view of the second link 5, and FIG. 3D is a side view of the second link 5.

The first link 4 is made so that the base component 18, the upper free end components 19A,19B and the lower free end Components 20A,20B form an H shape when viewed in plan. Supporting shafts 25A,25B are attached to the side face of the base component 18. Also, pin components 12A,12B are attached to the outside side faces of the lower free end components 20A,20B and the pin components 11A,11B extend from the outside sides of the upper free end components 19A,19B.

The second link 5 is structured so that the base component 22 and the free end components 24A,24B substantially form block U when viewed in plan. Supporting holes 21A,21B pass horizontally through the free end components 24A,24B. Into the supporting holes 21A,21B are inserted the supporting shafts 25A,25B of the first link 4. As a result, the first link 4 and the second link 5 are linked to provide rotational centering on the supporting shafts 25A,25B. To the outside sides of the free end components 24A,24B of the second link 5 are attached pins 14A,14B. Built into the base component 22 are rotational shafts 13A,13B. The depth of the supporting holes 21A,21B is dependent on the length of the support shaft 25A,25B which must be long enough to ensure a dependable linkage.

The first link 4 and the second link 5 are made of synthetic resin, such as glass fiber reinforced resin, as noted above. It is preferable that each link is made of a different material. If the materials are of different materials, little friction is produced between supporting holes 21A,21B, and the supporting shafts 25A,25B or at the contact faces of the first link 4 and the second link 5. However, if the area of contact points is small, then there is little problem if they are of the same material.

According to the embodiment, the structure is such that the distance between the center line of the first link 4 support shafts 25A 25B and the center line of top and bottom pin components 11A,11B and 12A,12B and the distance between the center line of the support holes 21A,21B of the second link 5 and the center line of the rotation shaft components 13A,13B and pin components 14A,14B are equal. When constructed in this way, as explained below, the guiding element 3 changes position, centered on the bottom side free edge component pins 12A,12B of the first link 4, so that keytop 2 can raise and lower maintaining a parallel position with regards to the upper face of the holder element 8 of the supporting base component 50.

The support base component 50 is composed of the holder element 8 which supports the guiding element 3, a flexible printed board 9 stretched across the bottom face of the holder element 8 so that switching component 29 (see FIG. 1A) is facing toward an opening 26 in the holder element 8, and strengthening board 10 beneath the printed board 9. The holder element 8 is made from a synthetic resin such as a glass reinforced synthetic resin, and the opening 26 is formed or created therein.

As shown in FIGS. 1A–3, a first spring element 6 is formed integral with the base component 18 of the first link 4. The first spring element 6 is a belt shaped flat spring and is further shaped for resilient shape changing by being bent twice, i.e., containing two generally oppositely directed bends to lengthen the flat spring. As a result, the properties of the first spring element 6 are improved and the lifetime of the first spring element 6 is increased. When the first spring element 6 is short, the load is concentrated on a single point and the first spring element 6 is easily broken. Also, the flat spring bends need not be limited to two. Thus, the distance between the ends of the first spring element 6, when it is folded, is shorter than the distance between the ends if first spring element 6 is stretched out in a straight line. Also, the tip 6A of the first spring element 6 is constructed so that it is in constant contact with the printed board 9. When the keytop 2 is depressed, the tip 6A slides while in contact with printed board 9.

At this point, to reduce friction resistance between the tip 6A of the first spring element 6 and the printed board 9, the structure is such that the tip 6A and the printed board 9 are in line or point contact. In the embodiment, the tip component 6*a* has the shape of a cylinder. When the user releases pressure after depressing the keytop 2, the keytop 2 is restored to the initial position (stroke 0 mm position) by the resilient restoring force of the first spring element 36 and the second spring element 7.

The second spring element 7, built integrally into the first link 4, makes possible the depression of the switching component 29, that is built into the printed board 9 by passing through the opening 26. Also, on the right and left sides of the opening 26 of the holder element 8 (left corresponding to the location of rotation fastener 27 and right corresponding to the location of the elongate groove Sliding fastener 28 as viewed in FIGS. 1A,1B) are injection molded the rotation fastener 27 and the elongate groove sliding fastener 28 so that each of the upper and lower components of the fasteners 27,28 will release. Also, with regard to the two rotation fasteners 27, the bottom edge pin components 12A,12B of the first link 4 are inserted so they can rotate therein and, with regard to the two sliding fasteners 28, free edge pin components 14A,14B of the second link 5 are inserted so they can slide therein.

The shape dimensions of the pins 11A,11B, the pins 14A,14B, and the sliding fasteners 16 (in the keytop 2), 28 (in the supporting base component 50) are set so that the first link 4 and the second link 5 become immobile relative to the FIG. 1A vertical direction, and also so that lateral sliding of pins 11A,11B and 14A,14B is uninhibited. Specifically, according to the embodiment, the base of each pin 11A,11B and 14A,14B is structured so that it will contact the inside face of the corresponding sliding fastener 16,28 and slide. Thus, the support shafts 25A,25B are prevented from slipping out of support holes 21A,21B.

Also, as Shown in FIGS. 1A and 1B, the second spring element 7 is integral with the base component 18 of the first link 4, so that it can be installed over the upper component of the switching component 29 (electrical contact point component) in the printed board 9. This second spring element 7 is made in a belt-shaped flat spring shape so that there will be overtravel (sliding) after the switching component 29 is electrically "on". Also, the tip 7A of the second spring element 7 is formed in a shape (for example, according to the present embodiment an arc, shape) that can reliably accomplish the switching movement of the switching component 29.

Figure 4:
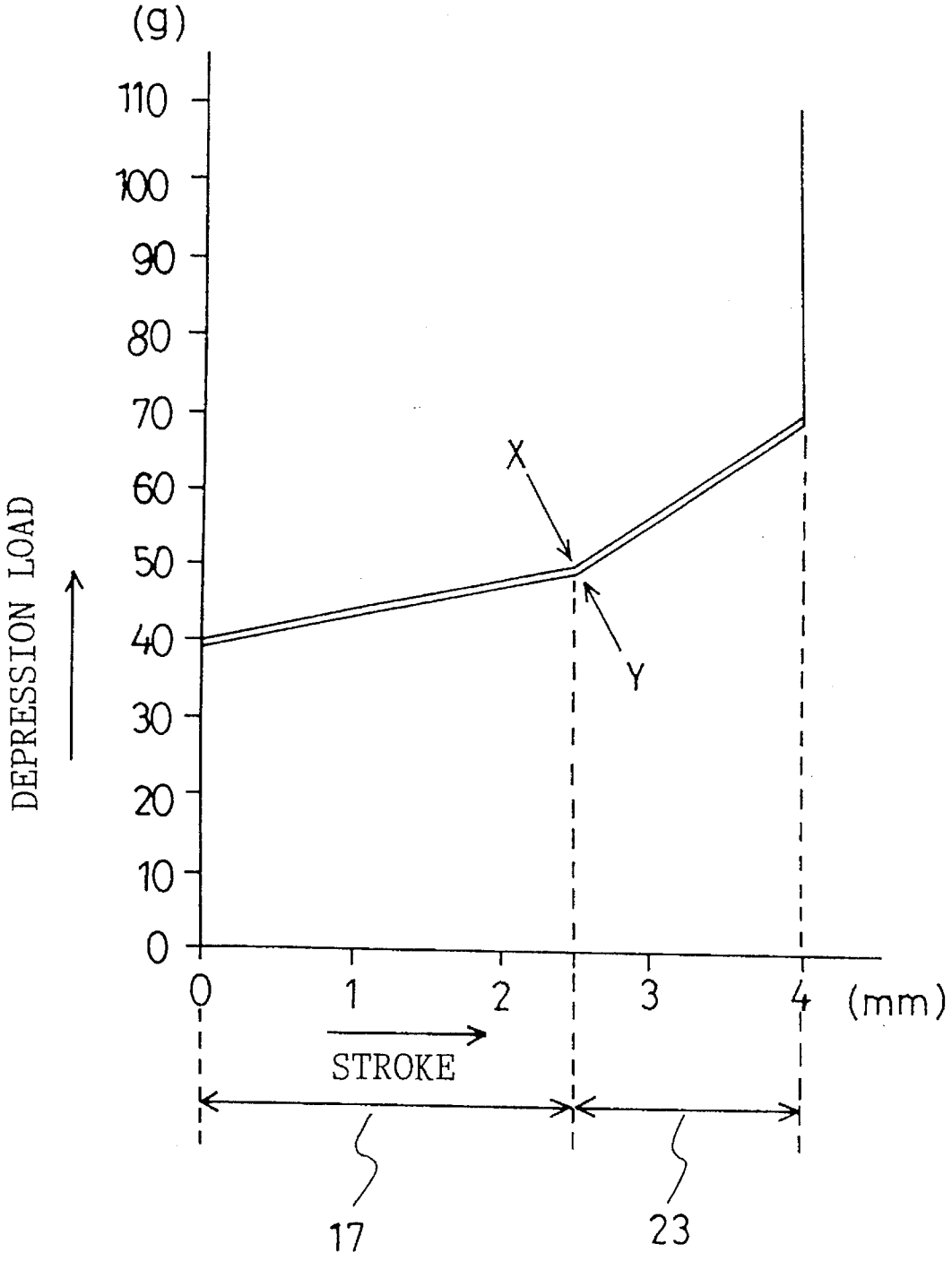
FIG. 4 is a drawing of the depression characteristics of the keyswitch of the embodiment of the invention.
Figure 5:
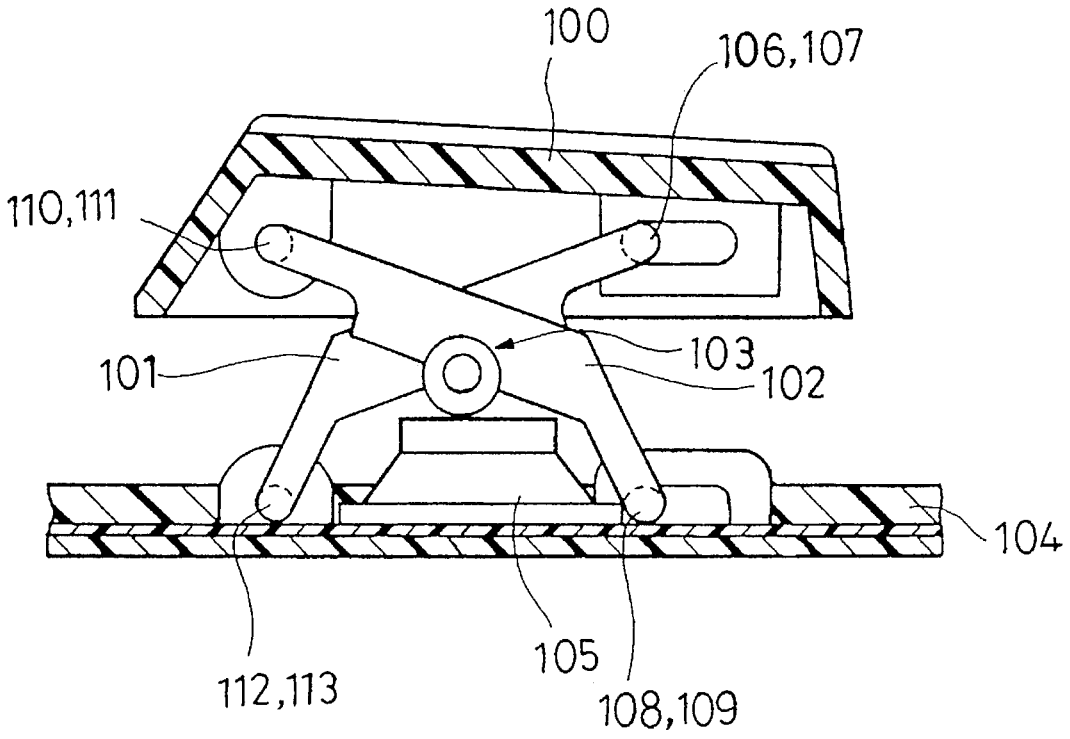
Fig.5 RELATED ART
FIG. 5 is a side section view of a keyswitch of the related art.

FIG. 4 shows the depression characteristics of keyswitch 1 by means of the first spring element 6 and the second spring element 7. The depression force for pretravel 17 space is determined by the spring characteristics of the first spring element 6 and the depression force for the overtravel 23 space is determined by the combination of the spring characteristics of the first spring element 6 and the second spring element 7. The depression force can be adjusted by changing the shapes and material specifications of the spring elements 6,7. Point X (FIG. 4) shows an electrical "on" point. When the stroke is at a position greater than point X, the keyswitch 1 is constantly electrically "on". Point Y shows an electrical "off" point. When the stroke is in a position less than point Y, the keyswitch 1 is constantly electrically "off". The points X, Y can also be adjusted by changing the shape of the spring elements 6,7. Because the depression force will necessarily change after the electrical "on" point at point X, due to the combination of spring characteristics of the first spring element 6 and the second spring element 7, the user can tell by touch when the keyswitch 1 is electrically "on".

In addition, because the first spring element 6 is formed in a folded state, there is already a certain amount of depression load on the first spring element 6 (about 40 grams as shown in FIG. 4). Therefore, the depression force to take the keyswitch 1 to the electrical "on" point X is that much reduced when reaching point X.

Next, the movement of the keyswitch 1 according to the embodiment will be explained with reference to FIGS. 1–4. When the user presses down on the keytop 2 of the keyswitch 1, the guiding element 3 rotates around pin components 12A,12B on first link 4 bottom free ends 20A, 20B, and changes position centering in resistance to the restoring force of the first spring element 6. At this time, the tip component 6A of first spring element 6 slides while in constant contact with printed board 9 and keytop 2 descends while remaining in a parallel position with regards to the top face of holder element 8.

Then, as shown in FIG. 4, when the stroke passes through the pretravel space 17 (0 mm–2.5 mm) and arrives at point X, the tip component 7A of second spring element 7 makes contact with switching component 29 to produce the switching movement. In addition, when the keytop 2 is further depressed by the user, the guiding element 3 further rotates around the pin components 12A,12B on the bottom free edge of the first link 4, and changes position centering against the resistance of the restoring force of the first spring element 6 and the second spring element 7, with the stroke within the overtravel space 23 (2.5 mm–4.0 mm), and the keytop 2 descends while remaining in a parallel position with regards to the top face of holder element 8.

Figure 2A:
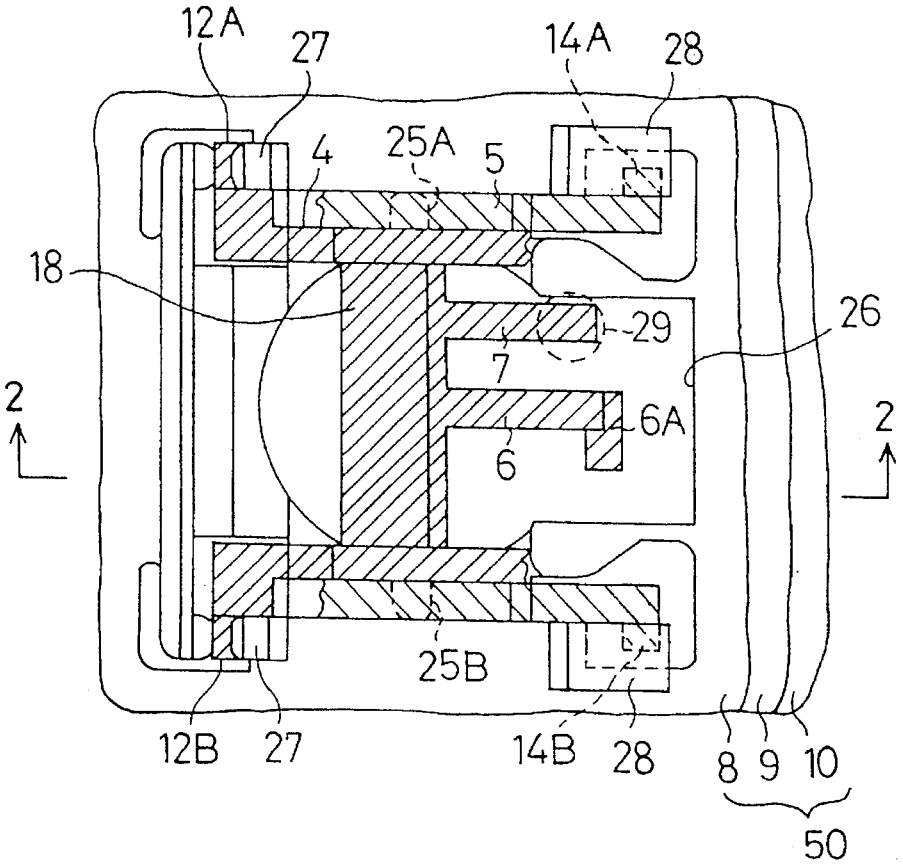
FIG. 2A is a top face view of the embodiment of the invention wherein the keyswitch has been depressed and the keytop removed and components of the two links removed.
Figure 2B:
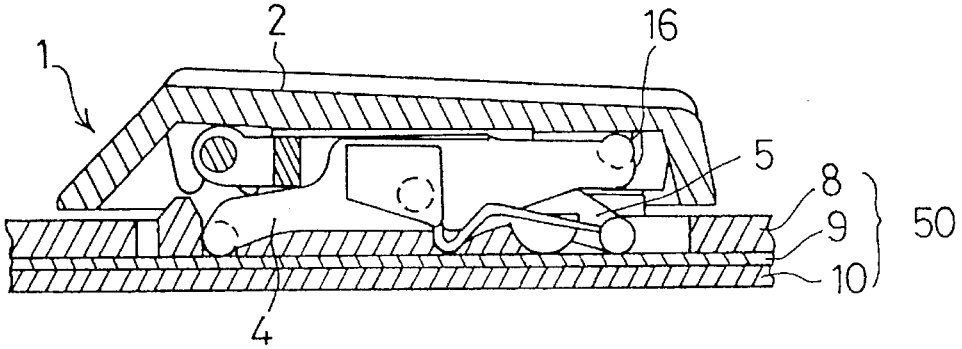
FIG. 2B is a side section view of the keyswitch along line 2—2 of FIG. 2A.

Then, when the keytop 2 reaches the lowest position (stroke at 4.0 mm), even if the user presses down further, the keytop 2 will not descend further. The keyswitch 1 is then as shown in FIG. 2B.

Last, when the user releases from depression the keytop 2, the keytop 2 is restored first to the point Y due to the resilient restoring force of the first spring element 6 and the second spring element 7. Then, the keytop 2 is restored to the initial position (stroke position 0 mm) due to the resilient restoring force of the first spring element 6.

As detailed above, because the keyswitch in the invention is molded with the first link element 4, the first spring element 6 and the second spring element 7 as one piece, benefits occur such as that the second spring element's 7 position with regards to the printed board's switching component is reliably set, switching movement can be reliably accomplished, and the depression load can be easily adjusted. Also, because rubber springs with a certain degree of thickness are eliminated, the keyswitch can be made thinner. As the number of components is reduced, the assembly time is reduced and a lower cost keyswitch can be provided.

The invention is not limited to the embodiment detailed above, and many modifications can be made to it without departing from the limits of the main intent thereof.

For example, according to the embodiment, each of the first and second spring elements 6,7 is attached to the first link 4, but it is acceptable that the design may be such that multiple springs of each kind are so attached. In this case, it is acceptable to have either multiple switching components for one keyswitch or only one switching component. If multiple switching components are attached, by changing the height of each spring element's tip component, each switching component's switching movement may be accomplished based on the amount of keytop depression so that one key may be set with many functions.

Also, the keyswitch 1 may be constructed so that the first and second spring elements 6,7 are attached to the second link 5.

Also, the supporting base 50 of the embodiment uses a three layer construction comprising a holder element 8, a printed board 9, and a strengthening board 10, but it is acceptable to make a holder element in a one layer board with a certain degree of hardness, and at the same time construct one printed-circuit layer. Also, other multiple layer constructions besides three are acceptable.

In addition, when making each spring element 6,7 in first link 4's base component 18, it is acceptable to make the link base material and the spring element material using different varieties of resin material, make a two color item, and/or to make the link component's resin material and the spring element's metal material in insert or outsert form.

What is claimed is:

1. A keyswitch assembly, comprising:

a keytop;

a supporting base component having a switching component attached to said supporting base;

a guiding element consisting of a first link and second link arranged to intersect in an X-shape directly connecting said keytop and said supporting base and guiding raising and lowering of said keytop;

a first spring element which is built into at least one of said first link and said second link which resiliently biases said guiding element to return a depressed keytop to a base position; and a second spring element which is built into at least one of said first link and said second link which causes switching of said switching component by contact when said keytop is depressed beyond a predetermined distance from the base position.

2. The keyswitch assembly according to claim 1, wherein said first spring element and said second spring element are built into said first link.

3. The keyswitch assembly according to claim 1, wherein said first spring element is in constant contact with said supporting base component during keytop depression and said second spring element contacts said switching component and causes switch movement after depression of said keytop the predetermined distance.

4. The keyswitch assembly according to claim 1, wherein said first link and said second link are made of different materials.

5. The keyswitch assembly according to claim 1, wherein each of said first link and said second link have two ends, one end of each link is rotatably mounted in one of said keytop and said supporting base and the other end of each link is slidably mounted in the other of said keytop and said supporting base.

6. The keyswitch assembly according to claim 5, wherein one end of said first link freely rotates in said supporting base and its other end slides in said keytop, and one end of said second link rotates in said keytop and its other end slides in said supporting base.

7. The keyswitch assembly according to claim 1, wherein said first spring element and said second spring element are made in a belt shaped, flat spring shape and integral with said first link.

8. The keyswitch assembly according to claim 1, wherein a tip component of said first spring element is made so as to have one of a spherical outer surface and a cylindrical outer surface, the cylindrical outer surface providing a line contact and the spherical outer surface providing point contact with said supporting base component.

9. The keyswitch assembly according to claim 1, wherein a tip component of each said spring element is made in a cylinder shape.

10. A keyswitch assembly, for use with a base of a keyboard, a surface of said keyboard having contact switches thereon, a contact switch opposing each keyswitch assembly, comprising:

a keytop;

a first link and a second link rotatably joined to one another to form an X-shape appearance when viewed in profile, said first link and said second link forming a key guide when joined;

a first spring attached to one of said first link and said second link, said first spring in constant contact with the keyboard;

a second spring attached to one of said first link and said second link, said second spring separated a predetermined distance from said keyboard when said keytop is in a base position established by said first spring and said key guide.

11. The keyswitch assembly according to claim 10, wherein a distance from a first end of said first link to where said first and second links are rotatably joined is equal to a distance from a second, opposite end of said first link to where said first and second links are rotatably joined and a distance from a first end of said second link and a distance from a second, opposite end of said second link to where said first and second links are rotatably joined are equal.

12. The keyswitch assembly according to claim 10, further comprising one of a plurality of first springs, a plurality of second springs and a plurality of both first and second springs.

13. The keyswitch assembly according to claim 10, wherein said base of said keyboard comprises:

a holder element;

a strengthening board; and a printed circuit board.

14. The keyswitch assembly according to claim 13, wherein said holder element and said strengthening board are combined to form a single layer.

15. The keyswitch assembly according to claim 10, wherein said first spring and said second spring are attached to said first link.

16. The keyswitch assembly according to claim 10, wherein said first link and said second link are formed of resin materials.

17. The keyswitch assembly according to claim 16 wherein said first spring and said second spring are integral to said first link.

18. The keyswitch assembly according to claim 10, wherein said first spring and said second spring are fixedly mounted to said first link.

19. The keyswitch assembly according to claim 10, wherein said first spring and said second spring have an elongated strip shape.

20. The keyswitch assembly according to claim 19, wherein at an end away from an end attached to said one of said first link and said second link, said first spring and said second Spring have a tip for making one of line and point contact with the keyboard.

21. The keyswitch assembly according to claim 19, wherein said first spring has at least two bends transverse to a longitudinal axis to effectively increase a length of said first spring.

22. The keyswitch assembly according to claim 10, wherein said second spring contacts and closes the opposing contact switch when said keytop has been depressed the predetermined distance.

23. The keyswitch assembly according to claim 10, wherein the keytop is supported by the first link and the second link.

24. The keyswitch assembly according to claim 23, wherein said first link has one end rotatably mounted to one of said keytop and the keyboard and an opposite end slidably retained on the other of said keytop and the keyboard and said second link has one end rotatably mounted to one of the keyboard and said keytop and an opposite end slideably retained on the other of the keyboard and said keytop.

* * * * *